US010626704B2

(12) United States Patent
Liu et al.

(10) Patent No.: US 10,626,704 B2
(45) Date of Patent: Apr. 21, 2020

(54) INTELLIGENT SWITCHING VALVE FOR RESERVOIR REFORMATION AND PRODUCTION MONITORING AND CONTROL AND CONSTRUCTION METHOD THEREFOR

(71) Applicants: Chengdu University of Technology, Chengdu (CN); SOUTHWEST PETROLEUM UNIVERSITY, Chengdu (CN)

(72) Inventors: Qingyou Liu, Chengdu (CN); Haiyan Zhu, Chengdu (CN); Gui Chen, Chengdu (CN); Guorong Wang, Chengdu (CN)

(73) Assignees: CHENGDU UNIVERSITY OF TECHNOLOGY, Chengdu (CN); SOUTHWEST PETROLEUM UNIVERSITY, Chengdu (CN)

( * ) Notice: Subject to any disclaimer, the term of this patent is extended or adjusted under 35 U.S.C. 154(b) by 165 days.

(21) Appl. No.: 16/065,855

(22) PCT Filed: Jul. 19, 2016

(86) PCT No.: PCT/CN2016/090390
§ 371 (c)(1),
(2) Date: Jun. 25, 2018

(87) PCT Pub. No.: WO2018/000470
PCT Pub. Date: Jan. 4, 2018

(65) Prior Publication Data

US 2019/0017349 A1 Jan. 17, 2019

(30) Foreign Application Priority Data

Jun. 29, 2016 (CN) ..... 2016 1 0492323

(51) Int. Cl.
*E21B 43/26* (2006.01)
*E21B 34/14* (2006.01)
(Continued)

(52) U.S. Cl.
CPC ..... *E21B 34/14* (2013.01); *E21B 34/066* (2013.01); *E21B 43/26* (2013.01); *E21B 47/12* (2013.01)

(58) Field of Classification Search
CPC .. E21B 34/066; E21B 34/14; E21B 2034/007; E21B 43/26
See application file for complete search history.

(56) References Cited

U.S. PATENT DOCUMENTS 9,010,442 B2 * 4/2015 Streich ..... E21B 34/063 166/374
9,051,810 B1 * 6/2015 Cuffe ..... E21B 34/066
(Continued)

FOREIGN PATENT DOCUMENTS

CN 102278091 A 12/2011
CN 103321628 A 9/2013
(Continued)

*Primary Examiner* — Kenneth L Thompson
(74) *Attorney, Agent, or Firm* — Bayramoglu Law Offices LLC

(57) ABSTRACT

The present invention relates to an intelligent switching valve for reservoir reformation and production monitoring and control. The intelligent switching valve comprises a connection short section, an electric short section, a fluid storage short section, a hydraulic control short section and a slide sleeve short section. The middle part of the intelligent switching valve is a full bore. In a working process, a casing coupling and a casing are connected and are mounted under the shaft as components of a well cementation casing. Wireless communication with ground equipment is realized through low-frequency electromagnetic waves to finish receiving/transmitting of working instructions and data. The
(Continued)

switching valve is opened and closed under electric and hydraulic control and external assisting is not needed in an opening or closing process. The number of times of opening and closing is not limited and the number of stages is not limited.

9 Claims, 7 Drawing Sheets

(51) Int. Cl.
*E21B 47/12* (2012.01)
*E21B 34/06* (2006.01)

(56) References Cited

U.S. PATENT DOCUMENTS

| | | | | |
|---|---|---|---|---|
| 9,121,247 | B2 | 9/2015 | George et al. | |
| 9,359,877 | B2 * | 6/2016 | Stout | E21B 34/10 |
| 2018/0252073 | A1 * | 9/2018 | Richards | E21B 47/12 |
| 2018/0274331 | A1 * | 9/2018 | Richards | E21B 34/14 |

FOREIGN PATENT DOCUMENTS

| | | | |
|---|---|---|---|
| CN | 103437747 | A | 12/2013 |
| CN | 104612647 | A | 5/2015 |
| CN | 104929603 | A | 9/2015 |
| CN | 105019862 | A | 11/2015 |
| CN | 106121585 | A | 11/2016 |
| CN | 106150468 | A | 11/2016 |

* cited by examiner

INTELLIGENT SWITCHING VALVE FOR RESERVOIR REFORMATION AND PRODUCTION MONITORING AND CONTROL AND CONSTRUCTION METHOD THEREFOR

CROSS REFERENCE TO RELATED APPLICATIONS

This application is the national phase entry of International Application No. PCT/CN2016/090390, filed on Jul. 19, 2016, which is based upon and claims priority to Chinese Patent Application No. 201610492323.6 filed on Jun. 29, 2016, the entire contents of which are incorporated herein by reference.

TECHNICAL FIELD

The present invention relates to the field of petroleum and natural gas development equipment, in particular to an intelligent switching valve for reservoir reformation, production monitoring and control and a construction method therefor.

BACKGROUND

With the deepening of exploration and development, shale gas and tight gas reservoirs have entered the stage of scale development. Large-scale fracturing methods such as staged fracturing and volume fracturing of horizontal wells have gradually become the main technologies for the development of oil and gas fields. The existing staged fracturing technologies mainly include: an open-hole packer plus slide sleeve staged fracturing technology, a drillable bridge plug staged fracturing technology, a large-bore bridge plug staged fracturing technology, a double-seal single-pressure staged fracturing technology and a hydraulic jet staged fracturing technology, but they have certain limitations. The open-hole packer plus slide sleeve staged fracturing technology cannot realize a full bore and has a limited number of stages because a slide sleeve needs to be opened by different grades of balls and ball seats. The drillable bridge plug can perform unlimited-stage large-scale fracturing, but is long in operation period and high in cost. The large-bore bridge plug staged fracturing technology maintains a large bore of a borehole without drilling, but still cannot achieve a full bore of the borehole. The double-seal single-pressure staged fracturing technology needs to drag a pipe string, which requires operations under pressure, such that the operations are complex and the construction period is long. The hydraulic jet staged fracturing technology has limited construction sections, long construction period and limited construction scale owing to its limited wear and erosion resistance of nozzles and large throttle pressure difference.

At present, the productivities of all levels of reservoirs during the development of oil fields are different. Conventional completion technologies and tools are difficult to achieve production control of all levels of reservoirs, and there are problems such as water-gas coning. At the same time, as the increase in the years of oilfield exploitation, many oilfields gradually enter a high-water-cut period, resulting in a large gap in the nature of oil reservoirs. The conventional profile modification and deplugging technology cannot maintain the normal production requirements of a high-water-cut well. In this context, an intelligent completion technology has developed more rapidly. This intelligent completion technology can realize layered mining and borehole mining, and control the mining speeds of different levels or different boreholes without shutting down the well, resulting in the increase of the overall production effectiveness. An intelligent switching valve is a key tool in intelligent completion and is mainly used to open, close or throttle one or more reservoirs. By adjusting the pressure between reservoirs, a flow rate of fluid, etc., the functions, such as profile modification and deplugging, production control, and production process adjustment can be realized. Therefore, it is meaningful to develop an intelligent switching valve for reservoir reformation, production monitoring and control.

Among the prior arts, the Chinese patent "Casing Unlimited-stage Staged Fracturing Method" (publication No.: CN104929603A), published on Sep. 23, 2015 is involved, in which, various stages are set in sequence by using a continuous pipe to drag a repeatable setting and releasing tool, and a slide sleeve is opened through annular pressurizing to perform sand fracturing. This method requires auxiliary tools, and is complicated in operations and long in working hours.

In the China Patent "Switchable Layered Fracturing Cementing slide sleeve and Construction Method Thereof", (Publication No.: CN104612647A), published on May 13, 2015, a bottom packer arranged on a multi-stage fracturing tool is pushed down by a coiled tubing in each reservoir, such that the bottom packer is set in an upper center tube, and a fracturing slide sleeve is then opened by the coiled tubing or by annular pressurizing. In this method, a ball seat is not required, and the number of stages for use of the slide sleeve is increased by a full bore. However, the use of the coiled tubing makes the number of stages still limited, and meanwhile the operation flows are complex and the time is long.

In the Chinese patent "Method for Unlimited-stage Staged Reformation of Horizontal Well" (publication No.: CN103437747A), published on Dec. 11, 2013, a control signal is delivered to a downhole slide sleeve through an input signal transmitter, a piston is pushed by a power mechanism to form a ball seat, and the fracturing operation is performed in a dropping-to-pressurizing manner. In this method, a ball seat is used, and the fracturing operation can be implemented in the order of stages. The formed ball seat cannot be reset, and the input ball cannot be recycled, which increases the difficulty of subsequent operations.

In the Chinese Patent "Accumulator-Driven Slide Sleeve Switch for Petroleum Completion" (publication No.: CN105019862A), published on Nov. 4, 2015, a slide sleeve is opened and closed by storing a gas having a certain pressure in a plurality of gas storage holes in a porous welding member as a power source of a hydraulic control circuit, by using a plurality of oil storage holes and oil return holes in the porous welding member as a hydraulic source of a pressure transmission medium, and by performing combined reversing on valves in the hydraulic control circuit. In this method, a mechanical structure is simplified by using an accumulator, but the on/off number of the accumulator is limited under the limitation of a volume of the accumulator and the affect of a switching mechanism. Due to the limited on-off number, the slide sleeve switch for completion has a single function and a low fault tolerance during operation.

In the Chinese Patent "Hydraulic Slide Sleeve" (Publication No.: CN102278091A), published on Dec. 14, 2011, two preset hydraulic channels are pressurized in sequence by a hydraulic pipeline, hydraulic oil pushes the slide sleeve to open and close to complete the opening, closing or throttling of a production channel in certain reservoir, thereby realizing production control. The hydraulic pipeline used in this method is difficult to achieve multi-stage installation and control, so the construction scale is limited. During the use process of this method, it is necessary to lower a tool to a designated reservoir after the fractured operation is completed, so the operation period is long, and the cost is high.

SUMMARY

The present invention aims to overcome the defects of the prior art, and provides an intelligent switching valve for reservoir reformation, and production monitoring and control and a construction method therefor. Multiple levels of intelligent switching valves are lowered to an artificial well bottom along with a cementation pipe string. Wireless communication between the ground and all levels of intelligent switching valves is realized through low-frequency electromagnetic waves, so as to transceive operation instructions and data. An electric and hydraulic control system drives the intelligent switching valves to be opened and closed. Numerical data of the temperature and pressure measured by a temperature and pressure sensor is used as references for setting a pressure value of a fracturing fluid during fracturing, such that the fracturing and productivity calibration operations of all levels of reservoirs are completed. Meanwhile, the intelligent switching valves are controlled to finish opening, closing or throttling actions according to monitoring data from the temperature and pressure sensor and other data of oil and gas reservoirs in the production process, thereby realizing profile modification and deplugging, production monitoring and control, and production process adjustment. Therefore, the outstanding problems of the existing staged fracturing technology, such as long operating period, high operating cost, and limited number of stages can be effectively solved. The outstanding problem that the conventional profile modification and deplugging technology cannot maintain the normal production of high-water-cut wells can also be effectively solved. The unlimited-stage large-scale staged fracturing reformation, and production monitoring and control of the reservoirs are achieved.

The objective of the present invention is realized by means of the following technical solution: an intelligent switching valve for reservoir reformation and production monitoring and control comprises a connection short section, an electric short section, a fluid storage short section, a hydraulic control short section and a slide sleeve short section, wherein the connection short section comprises a left coupling connector, a left end cover, a right end cover and a right coupling connector, wherein the left end cover is arranged at the right side of the left coupling connector, and the right end cover is arranged at the left side of the right coupling connector;

the electric short section comprises a mounting support, an electric connector, an electric inner wall and a universal outer wall, wherein the electric inner wall is coaxially sheathed inside the universal outer wall; the left end of the electric inner wall is connected with the inner surface of the right end of the left coupling connector in a threaded fit manner; the left end cover is cooperatively mounted at the left side of the electric inner wall, and the left end surface of the left end cover is closely attached to the right end surface of the left coupling connector; the left end of the universal outer wall is connected with the outer surface of the left end cover in a threaded fit manner; the electric connector is cooperatively mounted in the universal outer wall; the left end of the electric connector is connected with the right end of the electric inner wall in a threaded fit manner; the left end cover, the universal outer wall, the electric connector and the electric inner wall form an annular cavity; the mounting support is mounted in the annular cavity; the outside surface of the mounting support is provided with a plurality of grooves in which a circuit board, an antenna and a lithium battery are mounted respectively; the right end surface of the mounting support is further provided with a mounting support cable channel in which a lithium battery power line and a circuit board data line are laid; the electric connector is provided with an electric connector cable channel in an axial direction; a temperature and pressure sensor is also mounted on the inner wall in the middle of the electric connector and electrically connected with the circuit board;

the fluid storage short section comprises a fluid storage connector, a fluid storage inner wall and a universal outer wall, wherein the fluid storage connector is cooperatively mounted in the universal outer wall; the fluid storage inner wall is coaxially sheathed in the universal outer wall; the left end of the fluid storage inner wall is connected with the right end of the electric connector in a threaded fit manner, and the right end of the fluid storage inner wall is connected with the left end of the fluid storage connector in a threaded fit manner; the electric connector, the fluid storage inner wall, the fluid storage connector and the universal outer wall form an oil-storage annular cavity; the fluid storage connector is provided with a plurality of fluid storage connector cable channels and a plurality of fluid storage connector hydraulic oil channels in an axial direction; the fluid storage connector hydraulic oil channels are communicated with the oil-storage annular cavity;

the hydraulic control short section comprises a hydraulic control connector, a hydraulic control inner wall and a universal outer wall, wherein the hydraulic control inner wall is coaxially sheathed in the universal outer wall; the left end of the hydraulic control inner wall is connected with the right end of the fluid storage connector in a threaded fit manner; the inner surface and the outer surface of the left end of the hydraulic control connector are respectively connected with the hydraulic control inner wall and the universal outer wall in a threaded fit manner; the fluid storage connector, the universal outer wall, the hydraulic control connector and the hydraulic control inner wall form an annular cavity in which a hydraulic control system is mounted; the hydraulic control connector is provided with a plurality of first hydraulic channel hydraulic control short section segments and a plurality of second hydraulic channel hydraulic short section segments in an axial direction; the fluid storage connector hydraulic oil channels are communicated with the first hydraulic channel hydraulic control short section segments and the second hydraulic channel hydraulic control short section segments respectively;

the slide sleeve short section comprises a slide sleeve outer wall, a slide sleeve inner wall and an inner slide sleeve, wherein the left end of the slide sleeve outer wall is connected with the outer surface of the right end of the hydraulic control connector in a threaded fit manner, and the right end of the slide sleeve outer wall is connected with the outer surface of the left end of the right end cover in a threaded fit manner; the left end of the slide sleeve inner wall is connected with the inner surface of the right end of the hydraulic control connector in a threaded fit manner, and the right end of the slide sleeve inner wall is connected with the inner surface of the left end of the right coupling connector in a threaded fit manner; the right end surface of the right end cover is closely attached to the left end surface of the right coupling connector; the inner slide sleeve is slidably mounted between the slide sleeve outer wall and the slide sleeve inner wall; a plurality of slide sleeve outer wall fracturing fluid outlets is formed in the middle part of the side wall of the slide sleeve outer wall; a plurality of inner slide sleeve fracturing fluid outlets is formed in the middle part of the side wall of the inner slide sleeve; a plurality of slide sleeve inner wall fracturing fluid outlets is formed in the middle part of the side wall of the slide sleeve inner wall; during fracturing, the slide sleeve inner wall fracturing fluid outlets, the inner slide sleeve fracturing fluid outlets and the slide sleeve outer wall fracturing fluid outlets are aligned; the slide sleeve outer wall is provided with a second hydraulic channel slide sleeve outer wall section in an axial direction; the hydraulic control connector, the slide sleeve outer wall, the inner slide sleeve and the slide sleeve inner wall define a first hydraulic cavity; the first hydraulic channel hydraulic control short section segments are communicated with the first hydraulic cavity; the right end cover, the slide sleeve outer wall, the inner slide sleeve and the slide sleeve inner wall define a second hydraulic cavity; the second hydraulic channel hydraulic control short section segments are communicated with the second hydraulic cavity through the second hydraulic channel slide sleeve outer wall section.

The hydraulic control system comprises a two-position three-way electromagnetic reversing valve A, a two-position three-way electromagnetic reversing valve B, a direct current motor and a hydraulic pump, wherein an output end of the direct current motor is connected with an input end of a speed reducer; an output end of the speed reducer is connected with a power input end of the hydraulic pump; a fluid inlet of the hydraulic pump is connected with the oil-storage annular cavity; a fluid outlet of the hydraulic pump is connected with a first port of the two-position three-way electromagnetic reversing valve A and a first port of the two-position three-way electromagnetic reversing valve B respectively; a second port of the two-position three-way electromagnetic reversing valve A is communicated with the first hydraulic cavity; a second port of the two-position three-way electromagnetic reversing valve B is communicated with the second hydraulic cavity; a third port of the two-position three-way electromagnetic reversing valve A and a third port of the two-position three-way electromagnetic reversing valve B are communicated with the oil-storage annular cavity respectively.

A flowmeter is also arranged at the fluid outlet of the hydraulic pump; an overflow valve is also arranged between the fluid outlet of the hydraulic pump and the third port of the two-position three-way electromagnetic reversing valve A.

The inner surface of the slide sleeve outer wall is provided with a circumferential limiting groove in an axial direction; the outer wall of the inner slide sleeve is provided with a circumferential limiting pin in a radial direction; the circumferential limiting pin is in sliding fit with the circumferential limiting groove.

The slide sleeve outer wall is also provided with a slide sleeve outer wall fluid-injection opening which is communicated with the second hydraulic cavity.

The universal outer wall is also provided with a universal outer wall fluid-injection opening which is communicated with the oil-storage annular cavity.

A construction method for an intelligent switching valve for reservoir reformation and production monitoring and control comprises the following steps:

S1, lowering multiple levels of intelligent switching valves to an artificial well bottom along with a cementation pipe string;

S2, transmitting, by a ground control station, wireless communication signals to the shaft, wherein the signal content includes: opening a certain designated level of intelligent switching valve, and closing the other levels of intelligent switching valves;

S3, receiving, by each level of intelligent switching valves under the shaft, the signals, and opening or closing each level of fracturing fluid outlet by an electric and hydraulic control system according to instructions;

S4, transmitting, by the intelligent switching valve of the designated level under the shaft, numerical data signals of the temperature and pressure measured by the temperature and pressure sensor on this level to the ground control station, and determining, by the ground control station, the pressure required for formation fracturing on the basis of numerical data after receiving the numerical data, so as to provide references for setting of a pressure value of a fracturing fluid during fracturing;

S5, performing fracturing operation on a level where a fracturing fluid outlet is in an open state;

S6, repeating the steps S2-S4, till the fracturing of the entire well section is completed;

S7, repeating the steps S2-S3 to complete the calibration of the productivities of all the reservoirs in sequence;

S8, screening high-productivity reservoirs and transmitting, by the ground control station, wireless communication signals to the shaft, wherein the signal content includes: opening the intelligent switching valves of all the high-productivity reservoirs and closing the intelligent switching valves of other low-productivity reservoirs to achieve oil and gas production; and S9, controlling the intelligent switching valves to finish opening, closing or throttling actions according to monitoring data from the temperature and pressure sensor and other data of oil and gas reservoirs in the production process, thereby realizing production monitoring and control.

The cementation pipe string comprises a surface casing, a technical casing, a production casing, a cement ring, an intelligent switching valve and a casing coupling; the intelligent switching valve is connected with the production casing via the casing coupling.

The present invention has the following advantages:

1. In the present invention, the stable communication capability between the ground and the downhole is ensured in a wireless communication manner; the influences from a distance are eliminated; the problems for a control channel, such as long construction period and high cost, can be effectively solved.

2. The intelligent switching valve of the present invention realizes opening and closing of a slide sleeve by means of using electric and hydraulic control, without the need of lowering other auxiliary tools; the number of stages and the time of opening and closing are not limited; the opening and closing actions of a plurality of slide sleeves can be achieved just by one instruction; the outstanding problems of the existing staged fracturing technology, such as long operating period, high operating cost, and limited number of stages can be effectively solved.

3. According to the intelligent switching valve of the present invention, the middle part is a full bore, such that the flowing area is large; the full bore can be used as a fluid channel during fracturing, or can be used as a production channel for oil and natural gas during production, or can also be used as a channel for other downhole tools to lower.

4. According to the intelligent switching valve of the present invention, a flowmeter is used to detect the flow rate of hydraulic oil, and the flow rate is then converted into the stroke of the inner slide sleeve through programs in the circuit board; the stroke data of the inner slide sleeve is transmitted to the ground by means of wireless communication to realize the detection and control of the opening size of the fracturing fluid outlet.

5. According to the intelligent switching valve of the present invention, temperature and pressure data in the downhole environment are detected by using the pressure and temperature sensor, and stroke data is transmitted to the ground by means of wireless communication; during fracturing, the numerical data of the temperature and pressure measured by the temperature and pressure sensor may be used as references for setting of a pressure value of the fracturing fluid; during production, the intelligent switching valves are controlled to finish opening, closing and throttling actions by analyzing monitoring data from the temperature and pressure sensor and other data of oil and gas reservoirs, thereby realizing profile modification and deplugging, production monitoring and control, and production process adjustment.

6. The intelligent switching valve of the present invention can be used as a fracturing tool to achieve fracturing operations, and can also be used as a production tool to achieve production operations. At the same time, production monitoring and control can be performed during the production process, thereby effectively simplifying the fracturing production operation process. The intelligent switching valve is a new oil and gas development tool.

7. According to the construction method of the present invention, subsequent operations can be completed by lowering the intelligent switching sleeve once to finish a fracturing task, a productivity calibration task, a production task, and a production monitoring and control task, such that the traditional completion and production process is effectively simplified. The construction method is a new oil and gas development process.

Figure 1:
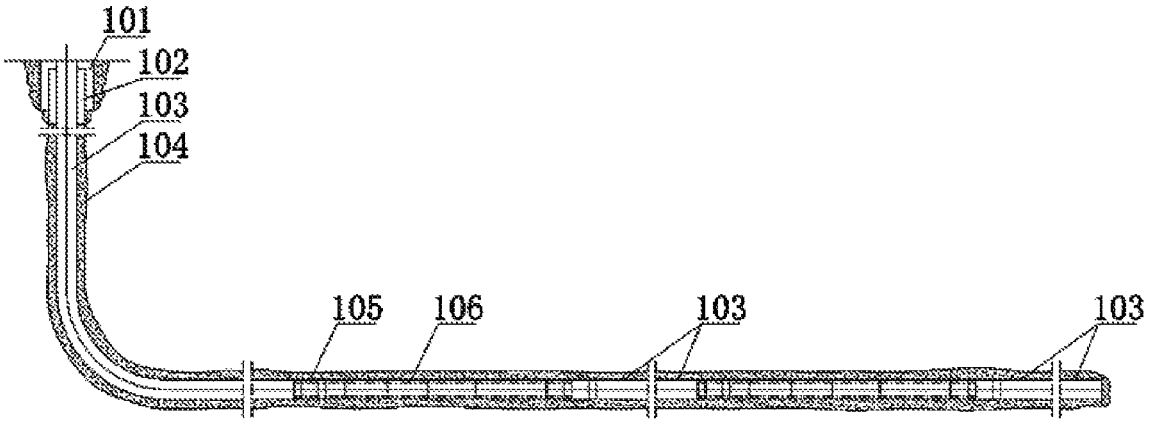
FIG. 1 is a schematic structural diagram of a pipe string in a construction method according to the present invention.

In the drawings, sign references represent the following components: 1—left coupling connector; 2—left end cover; 3—mounting support; 4—electric connector; 5—fluid storage connector; 6—hydraulic control connector; 7—inner slide sleeve; 8—right end cover; 9—right coupling connector; 10—slide sleeve outer wall; 11—slide sleeve inner wall; 12—hydraulic control inner wall; 13—fluid storage inner wall; 14—universal outer wall; 15—electric inner wall; 101—surface casing; 102—technical casing; 103—production casing; 104—cement ring; 105—casing coupling; 106—intelligent switching valve; 301—circuit board; 302—antenna; 303—lithium battery; 304—mounting support cable channel; 401—electric connector cable channel; 402—temperature and pressure sensor; 501—fluid connector cable channel; 502—fluid storage connector hydraulic oil channel; 601—first hydraulic channel hydraulic control short section segment; 602—second hydraulic channel hydraulic control short section segment; 603—two-position three-way electromagnetic reversing valve; 604—two-position two-way electromagnetic reversing valve A; 605—overflow valve; 606—direct current motor; 607—speed reducer; 608—hydraulic pump; 609—flowmeter; 610—two-position two-way electromagnetic reversing valve B; 701—inner slide sleeve fracturing fluid outlet; 702—circumferential limiting pin; 703—slide sleeve inner wall fracturing fluid outlet; 704—slide sleeve outer wall fracturing fluid outlet; 801—universal outer wall fluid-injection opening; 802—slide sleeve outer wall fluid-injection opening; 803—circumferential limiting groove; 804—second hydraulic channel slide sleeve outer wall section; 901—oil-storage annular cavity.

DETAILED DESCRIPTION

The present invention will be further described with reference to the accompanying drawings, but the scope of protection of the present invention is not limited to the followings.

Figure 2A:
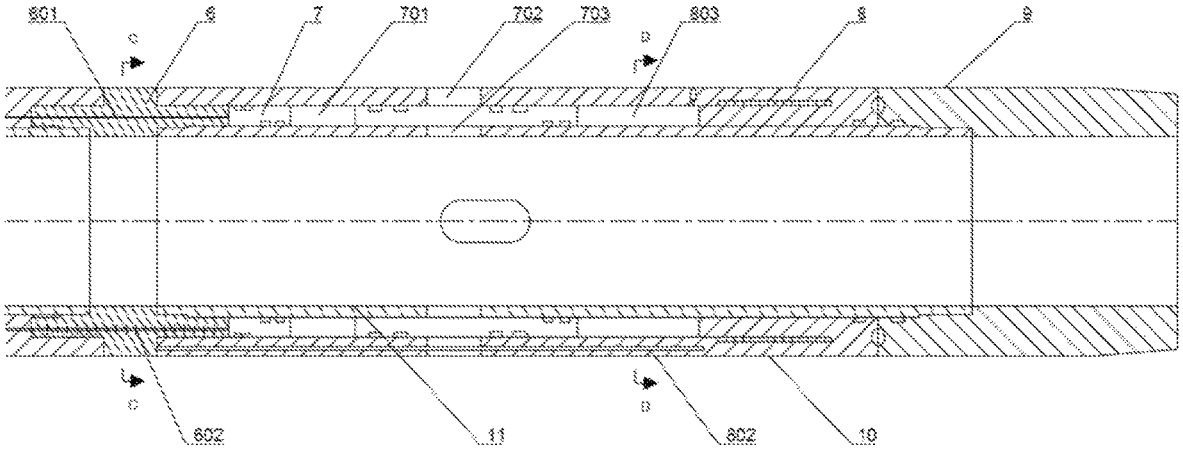
FIG. 2A is an upper part of schematic structural diagram of an intelligent switching valve according to the present invention.
Figure 2B:
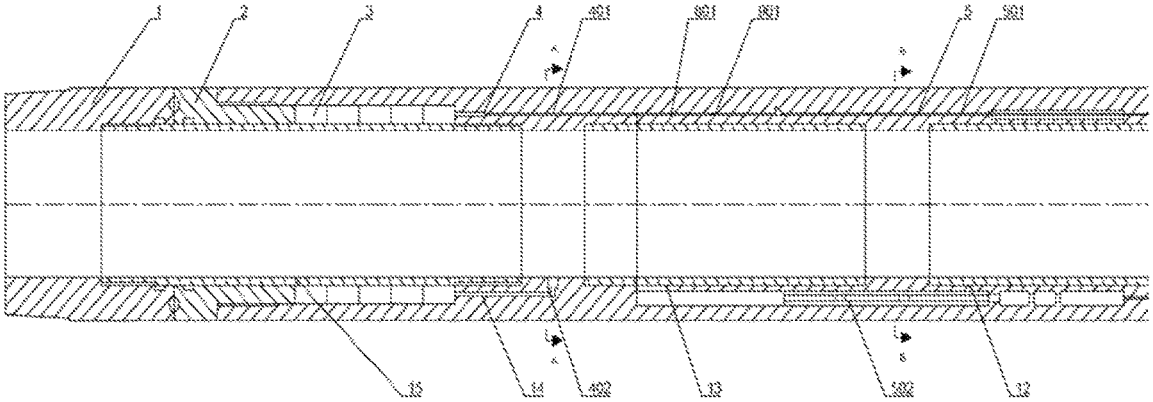
FIG. 2B is a lower part of schematic structural diagram of an intelligent switching valve according to the present invention.
Figure 3:
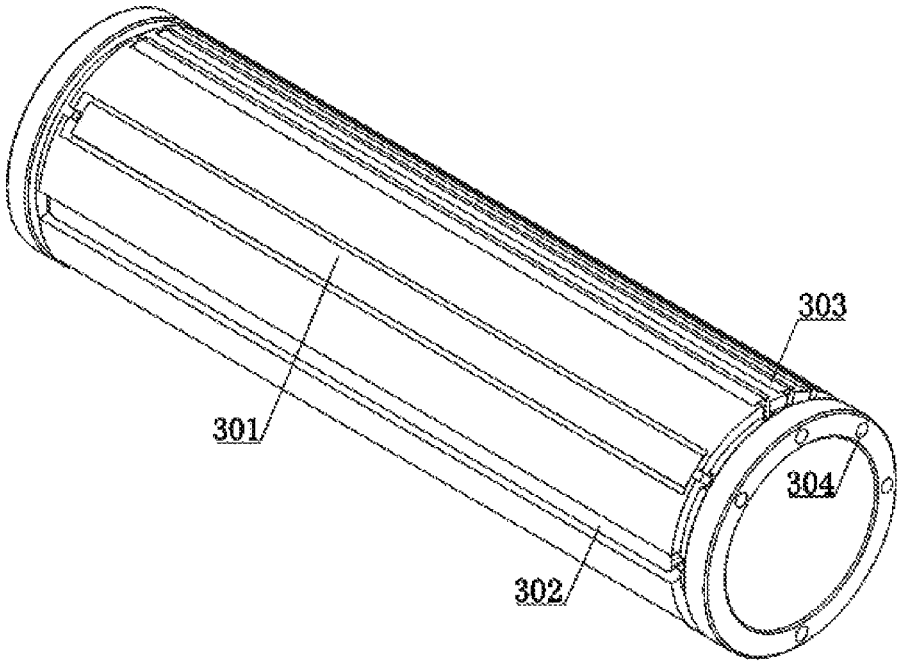
FIG. 3 is a schematic structural diagram of a mounting support.
Figure 4:
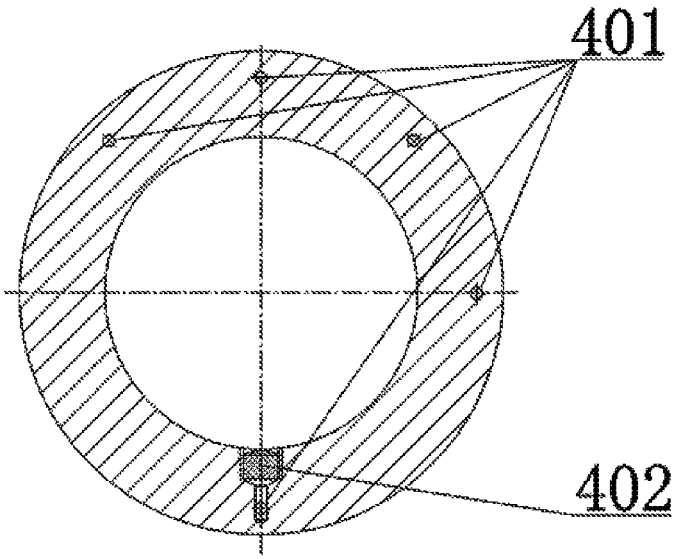
FIG. 4 is a sectional schematic structural diagram of A-A in FIG. 2B.
Figure 5:
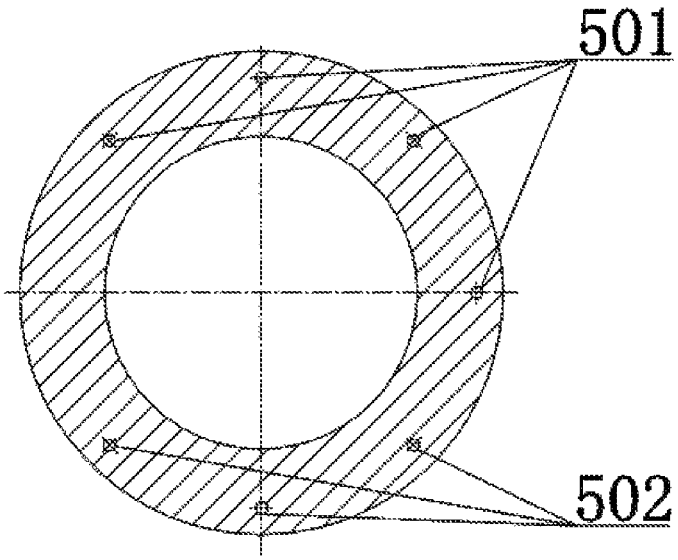
FIG. 5 is a sectional schematic structural diagram of B-B in FIG. 2B.
Figure 6:
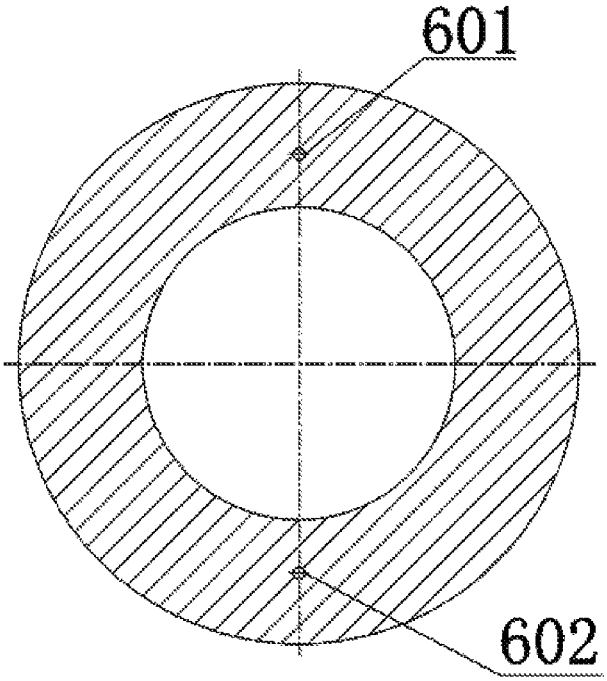
FIG. 6 is a sectional schematic structural diagram of C-C in FIG. 2A.
Figure 8:
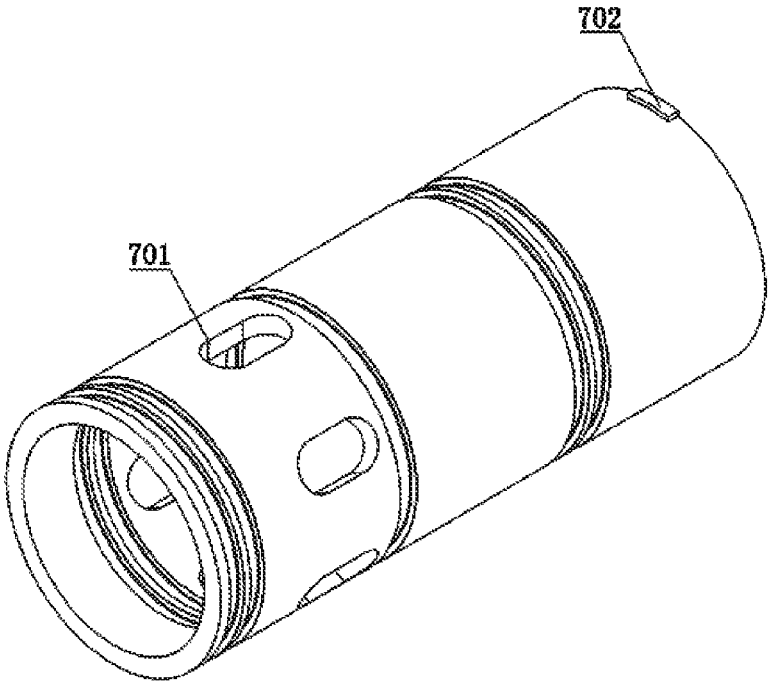
FIG. 8 is a schematic structural diagram of an inner slide sleeve.

As shown in FIG. 2A and FIG. 2B, an intelligent switching valve for reservoir reformation and production monitoring and control comprises a connection short section, an electric short section, a fluid storage short section, a hydraulic control short section and a slide sleeve short section. The connection short section comprises a left coupling connector 1, a left end cover 2, a right end cover 8 and a right coupling connector 9. The left end cover 2 is arranged at the right side of the left coupling connector 1, and the right end cover 8 is arranged at the left side of the right coupling connector 9. As shown in FIG. 3 and FIG. 4, the electric short section comprises a mounting support 3, an electric connector 4, an electric inner wall 15 and a universal outer wall 14, wherein the electric inner wall 15 is coaxially sheathed inside the universal outer wall 4. The left end of the electric inner wall 15 is connected with the inner surface of the right end of the left coupling connector 1 in a threaded fit manner. The left end cover 2 is cooperatively mounted at the left side of the electric inner wall 15, and the left end surface of the left end cover 2 is closely attached to the right end surface of the left coupling connector 1. The left end of the universal outer wall 14 is connected with the outer surface of the left end cover 2 in a threaded fit manner. The electric connector 4 is cooperatively mounted in the universal outer wall 14. The left end of the electric connector 4 is connected with the right end of the electric inner wall 15 in a threaded fit manner. The left end cover 2, the universal outer wall 14, the electric connector 4 and the electric inner wall 15 form an annular cavity. The mounting support 3 is mounted in the annular cavity. The outside surface of the mounting support 3 is provided with a plurality of grooves in which a circuit board 301, an antenna 302 and a lithium battery 303 are mounted respectively. The right end surface of the mounting support 3 is further provided with a mounting support cable channel 304 in which a lithium battery power line and a circuit board data line are laid. In the present invention, the mounting support 3 has four through holes distributed at equal intervals of 45 degrees in the left end and one through hole symmetrically distributed with the second through hole in a clockwise direction. The electric connector 4 is provided with an electric connector cable channel 401 in an axial direction. In the present embodiment, the electric connector cable channel 401 has four through holes at equal intervals of 45 degrees in the left end of the electric connector 4 and one blind hole symmetrically distributed with the second through hole in a clockwise direction. A temperature and pressure sensor 402 is also mounted on the inner wall in the middle of the electric connector 4, electrically connected with the circuit board 301 and used for detecting numerical signals of the temperature and pressure under the shaft and transmitting the numerical signals to the circuit board 301. As shown in FIG. 2B and FIG. 5, the fluid storage short section comprises a fluid storage connector 5, a fluid storage inner wall 13 and a universal outer wall 14, wherein the fluid storage connector 5 is cooperatively mounted in the universal outer wall 14. The fluid storage inner wall 13 is coaxially sheathed in the universal outer wall 14. The left end of the fluid storage inner wall 13 is connected with the right end of the electric connector 4 in a threaded fit manner, and the right end of the fluid storage inner wall 13 is connected with the left end of the fluid storage connector 5 in a threaded fit manner. The electric connector 4, the fluid storage inner wall 13, the fluid storage connector 5 and the universal outer wall 14 form an oil-storage annular cavity 901. The fluid storage connector 5 is provided with a plurality of fluid storage connector cable channels 501 and a plurality of fluid storage connector hydraulic oil channels 502 in an axial direction. In the present embodiment, the fluid storage connector 5 has four fluid storage connector cable channels 501 distributed at equal intervals of 45 degrees, and three fluid storage connector hydraulic oil channels 502 distributed at equal intervals of 45 degrees, and the fluid storage connector hydraulic oil channels 502 are communicated with the oil-storage annular cavity 901. As shown in FIG. 2A and FIG. 6, the hydraulic control short section comprises a hydraulic control connector 6, a hydraulic control inner wall 12 and a universal outer wall 14, wherein the hydraulic control inner wall 12 is coaxially sheathed in the universal outer wall 14. The left end of the hydraulic control inner wall 12 is connected with the right end of the fluid storage connector 5 in a threaded fit manner. The inner surface and the outer surface of the left end of the hydraulic control connector 6 are respectively connected with the hydraulic control inner wall 12 and the universal outer wall 14 in a threaded fit manner. The fluid storage connector 5, the universal outer wall 14, the hydraulic control connector 6 and the hydraulic control inner wall 12 form an annular cavity in which a hydraulic control system is mounted; the hydraulic control connector 6 is provided with a plurality of first hydraulic channel hydraulic control short section segments 601 and a plurality of second hydraulic channel hydraulic short section segments 602 in an axial direction. The fluid storage connector hydraulic oil channels 502 are communicated with the first hydraulic channel hydraulic control short section segments 601 and the second hydraulic channel hydraulic control short section segments 602 respectively. As shown in FIG. 2A, the slide sleeve short section comprises a slide sleeve outer wall 10, a slide sleeve inner wall 11 and an inner slide sleeve 7, wherein the left end of the slide sleeve outer wall 10 is connected with the outer surface of the right end of the hydraulic control connector 6 in a threaded fit manner, and the right end of the slide sleeve outer wall 10 is connected with the outer surface of the left end of the right end cover 8 in a threaded fit manner. The left end of the slide sleeve inner wall 11 is connected with the inner surface of the right end of the hydraulic control connector 6 in a threaded fit manner, and the right end of the slide sleeve inner wall 11 is connected with the inner surface of the left end of the right coupling connector 9 in a threaded manner. The right end surface of the right end cover 8 is closely attached to the left end surface of the right coupling connector 9. The inner slide sleeve 7 is slidably mounted between the slide sleeve outer wall 10 and the slide sleeve inner wall 11. A plurality of slide sleeve outer wall fracturing fluid outlets 704 is formed in the middle part of the side wall of the slide sleeve outer wall 10. As shown in FIG. 8, a plurality of inner slide sleeve fracturing fluid outlets 701 is formed in the middle part of the side wall of the inner slide sleeve 7. A plurality of slide sleeve inner wall fracturing fluid outlets 703 is formed in the middle part of the side wall of the slide sleeve inner wall 11. In the present embodiment, the slide sleeve inner wall 11, the inner slide sleeve 7 and the slide sleeve outer wall 10 are respectively provided with six fracturing fluid outlets which are distributed at equal intervals in a circumferential direction. During fracturing, the slide sleeve inner wall fracturing fluid outlets 703, the inner slide sleeve fracturing fluid outlets 701 and the slide sleeve outer wall fracturing fluid outlets 704 are aligned. The slide sleeve outer wall 10 is provided with a second hydraulic channel slide sleeve outer wall section 804 in an axial direction. The hydraulic control connector 6, the slide sleeve outer wall 10, the inner slide sleeve 7 and the slide sleeve inner wall 11 define a first hydraulic cavity. The first hydraulic channel hydraulic control short section segments 601 are communicated with the first hydraulic cavity. The right end cover 8, the slide sleeve outer wall 10, the inner slide sleeve 7 and the slide sleeve inner wall 11 define a second hydraulic cavity. The second hydraulic channel hydraulic control short section segments 602 are communicated with the second hydraulic cavity through the second hydraulic channel slide sleeve outer wall section 804.

Figure 7:
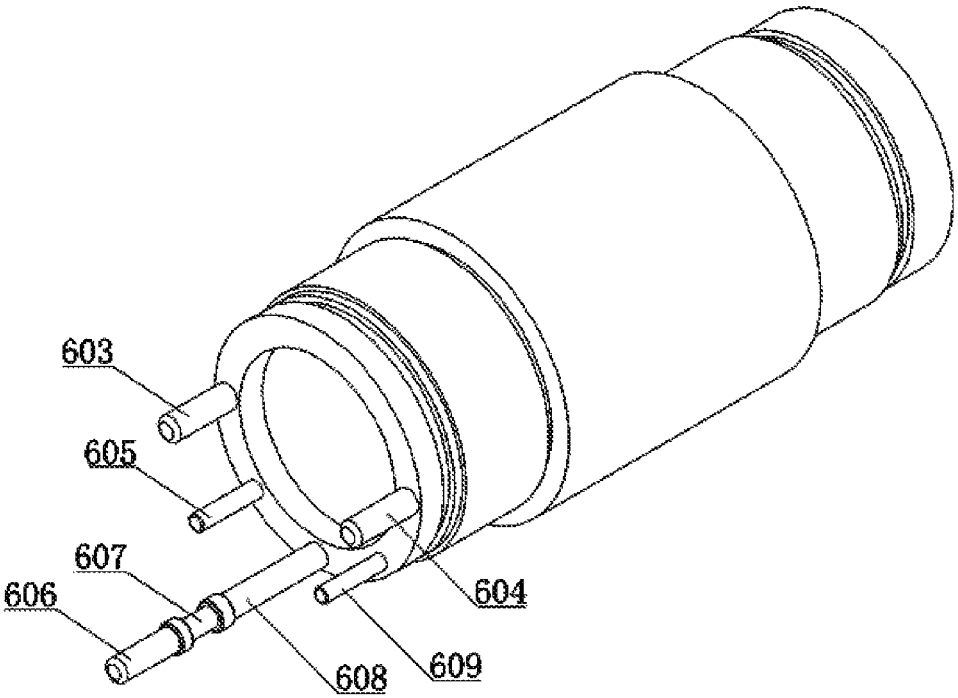
FIG. 7 is a schematic structural diagram during mounting of a hydraulic control system.
Figure 10:
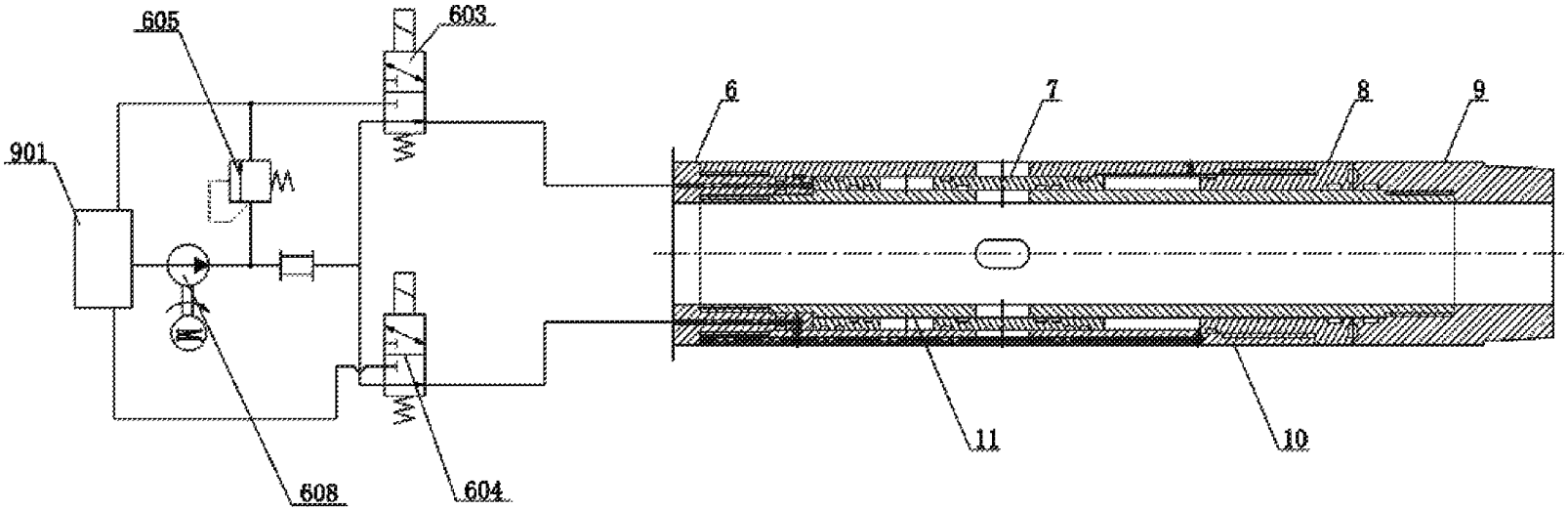
FIG. 10 is a schematic diagram of hydraulic control of the intelligent switching valve.

As shown in FIG. 7 and FIG. 10, the hydraulic control system comprises a two-position three-way electromagnetic reversing valve A 603, a two-position three-way electromagnetic reversing valve B 604, a direct current motor 606 and a hydraulic pump 608, wherein an output end of the direct current motor 606 is connected with an input end of a speed reducer 607. An output end of the speed reducer 607 is connected with a power input end of the hydraulic pump 608. A fluid inlet of the hydraulic pump 608 is connected with the oil-storage annular cavity 901. A fluid outlet of the hydraulic pump 608 is connected with a first port of the two-position three-way electromagnetic reversing valve A 603 and a first port of the two-position three-way electromagnetic reversing valve B 604. A second port of the two-position three-way electromagnetic reversing valve A 603 is communicated with the first hydraulic cavity. A second port of the two-position three-way electromagnetic reversing valve B 604 is communicated with the second hydraulic cavity. A third port of the two-position three-way electromagnetic reversing valve A 603 and a third port of the two-position three-way electromagnetic reversing valve B 604 are communicated with the oil-storage annular cavity 901 respectively. A flowmeter 609 is also arranged at the fluid outlet of the hydraulic pump 608, electrically connected with the circuit board 301 and used for detecting a flow rate signal of hydraulic oil flowing into the hydraulic cavity and transmitting a flow rate sensing signal to the circuit board 301. An overflow valve 605 is also arranged between the fluid outlet of the hydraulic pump 608 and the third port of the two-position three-way electromagnetic reversing valve A 603. When a wireless communication system receives an instruction to open the intelligent switching valve on the ground and when the two-position three-way electromagnetic reversing valve A 603 and the two-position three-way electromagnetic reversing valve B 604 are both in an off state, the switching valve in this case does not operate. When the three-position three-way electromagnetic reversing valve A 603 is powered on and the three-position three-way electromagnetic reversing valve B 604 is powered off, the fluid in the first hydraulic cavity flows back to the oil-storage annular cavity 901, and the fluid in the oil-storage annular cavity 901 flows to the second hydraulic cavity to push the inner slide sleeve 7 to move to the left. When the left end surface of the inner slide sleeve 7 is in contact with the hydraulic control connector 6, the intelligent switching valve is closed completely. When the three-position three-way electromagnetic reversing valve A 603 is powered off and the three-position three-way electromagnetic reversing valve B 604 is powered on, the fluid in the second hydraulic cavity flows back to the oil-storage annular cavity 901, and the fluid in the oil-storage annular cavity 901 flows to the first hydraulic cavity to push the inner slide sleeve 7 to move to the right. When the inner slide sleeve fracturing fluid outlets 701 in the inner slide sleeve 7, the slide sleeve inner wall fracturing fluid outlets 703 in the slide sleeve inner wall 11 and the slide sleeve outer wall fracturing fluid outlets 704 in the slide sleeve outer wall 10 are aligned, the intelligent switching valve is opened completely. In the opening and closing processes, hydraulic oil flows through the flowmeter 609, and the flowmeter 609 can transmit flow rate data to the circuit board 301 via a cable. The flow rate data is then converted into a stroke of the inner slide sleeve 7 via program processing, and is then wirelessly transmitted to the ground. Ground operators can issue instructions of continuing to open or close the intelligent switching valves according to the stroke of the inner slide sleeve 7, thereby realizing slide sleeve stroke control and achieving the purpose of controlling the areas of the fracturing fluid outlets.

Figure 9:
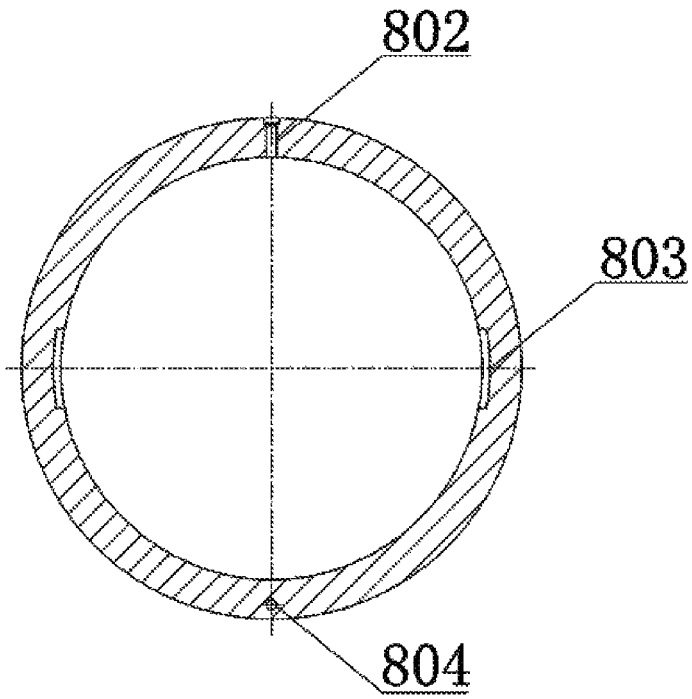
FIG. 9 is a sectional schematic structural diagram of D-D in FIG. 2A.

As shown in FIG. 9, the inner surface of the slide sleeve outer wall 10 is provided with a circumferential limiting groove 803 in an axial direction; the outer wall of the inner slide sleeve 7 is provided with a circumferential limiting pin 702 in a radial direction; the circumferential limiting pin 702 is in sliding fit with the circumferential limiting groove 803.

As shown in FIG. 2A, the slide sleeve outer wall 10 is also provided with a slide sleeve outer wall fluid-injection opening 802 which is communicated with the second hydraulic cavity.

As shown in FIG. 2B, the universal outer wall 14 is also provided with a universal outer wall fluid-injection opening 801 which is communicated with the oil-storage annular cavity 901.

The working process of the intelligent switching valve of the present invention is as follows: during cementing, according to the set number of fracturing stages, a corresponding number of intelligent switching valves are used as components of the cementation pipe string to be connected with the casing and installed under the shaft; during the fracturing operation, wireless communication with ground equipment is realized through low-frequency electromagnetic waves to finish receiving/transmitting of fracturing operation instructions and data, wherein the fracturing operation instructions are in the form of opening a slide sleeve of certain fracturing level and closing slide sleeves of other levels; after the fracturing operation instructions are received, the slide sleeve of a designated level is opened and the slide sleeves of other levels are closed under electric and hydraulic control; numerical data of the temperature and pressure measured by the temperature and pressure sensor are used as references for setting of a pressure value of a fracturing fluid, and in this case, the fracturing operation is performed at the opened slide sleeve, and a packing operation is performed at the closed slide sleeves; then, the fracturing of various levels of reservoirs can be finished just by issuing the fracturing operation instructions; after the fracturing operation is completed, instructions are issued in sequence again to open the intelligent switching valves at various reservoirs to communicate the reservoirs with the borehole in sequence, thereby establishing an oil and gas resource delivery channel and realizing the productivity calibration of the reservoirs; after the productivity calibration operation is completed, the production operation instructions are transmitted through wireless communication, wherein the production operation instructions are in the form of opening the slide sleeve in the high-productivity reservoir; after the production operation instructions are received, the slide sleeves of all the levels are opened under electric and hydraulic control to communicate the high-productivity reservoir with the borehole, thereby establishing an oil and gas resource delivery channel and realizing production operation; in the production process, the instructions are issued according to monitoring data of the temperature and pressure sensor and other data of oil and gas reservoirs to control the intelligent switching valves to finish opening, closing or throttling actions, thereby realizing production monitoring and control.

A construction method for an intelligent switching valve for reservoir reformation and production monitoring and control comprises the following steps:

S1, lowering multiple levels of intelligent switching valves to an artificial well bottom along with a cementation pipe string;

S2, transmitting, by a ground control station, wireless communication signals to the shaft, wherein the signal content includes: opening a certain designated level of intelligent switching valve, and closing the other levels of intelligent switching valves;

S3, receiving, by each level of intelligent switching valves under the shaft, the signals, and opening or closing each level of fracturing fluid outlet by an electric and hydraulic control system according to instructions;

S4, transmitting, by the intelligent switching valve of the designated level under the shaft, numerical data signals of the temperature and pressure measured by the temperature and pressure sensor on this level to the ground control station, and determining, by the ground control station, the pressure required for formation fracturing on the basis of numerical data after receiving the numerical data, so as to provide references for setting of a pressure value of a fracturing fluid during fracturing;

S5, performing fracturing operation on a level where a fracturing fluid outlet is in an open state;

S6, repeating the steps S2-S4, till the fracturing of the entire well section is completed; S7, repeating the steps S2-S3 to complete the calibration of the productivities of all the reservoirs in sequence;

S8, screening high-productivity reservoirs and transmitting, by the ground control station, wireless communication signals to the shaft, wherein the signal content includes: opening the intelligent switching valves of all the high-productivity reservoirs and closing the intelligent switching valves of other low-productivity reservoirs to achieve oil and gas production; and S9, controlling the intelligent switching valves to finish opening, closing or throttling actions according to monitoring data from the temperature and pressure sensor and other data of oil and gas reservoirs in the production process, thereby realizing production monitoring and control.

As shown in FIG. 1, the cementation pipe string comprises a surface casing 101, a technical casing 102, a production casing 103, a cement ring 104, an intelligent switching valve and a casing coupling 105; the intelligent switching valve 106 is connected with the production casing 103 via the casing coupling 105.

We claim:

1. An intelligent switching valve for reservoir reformation and production monitoring and control, comprising a connection short section, an electric short section, a fluid storage short section, a hydraulic control short section and a slide sleeve short section, wherein the connection short section comprises a left coupling connector, a left end cover, a right end cover and a right coupling connector, wherein the left end cover is arranged at a_right side of the left coupling connector, and the right end cover is arranged at a left side of the right coupling connector;

the electric short section comprises a mounting support, an electric connector, an electric inner wall and a universal outer wall, wherein the electric inner wall is coaxially sheathed inside the universal outer wall; a left end of the electric inner wall is connected with an inner surface of a right end of the left coupling connector; the left end cover is cooperatively mounted at a left side of the electric inner wall, and a left end surface of the left end cover is closely attached to a right end surface of the left coupling connector; a left end of the universal outer wall is connected with an outer surface of the left end cover; the electric connector is cooperatively mounted in the universal outer wall; a left end of the electric connector is connected with a right end of the electric inner wall; the left end cover, the universal outer wall, the electric connector and the electric inner wall form a first annular cavity; the mounting support is mounted in the first annular cavity; an outside surface of the mounting support is provided with a plurality of grooves in which a circuit board, an antenna and a lithium battery are mounted respectively; a right end surface of the mounting support is further provided with a mounting support cable channel in which a lithium battery power line and a circuit board data line are laid; the electric connector is provided with an electric connector cable channel in an axial direction; a temperature and pressure sensor is also mounted on an inner wall in a middle of the electric connector and electrically connected with the circuit board;

the fluid storage short section comprises a fluid storage connector, a fluid storage inner wall and a universal outer wall, wherein the fluid storage connector is cooperatively mounted in the universal outer wall; the fluid storage inner wall is coaxially sheathed in the universal outer wall; a left end of the fluid storage inner wall is connected with a right end of the electric connector, and a right end of the fluid storage inner wall is connected with a left end of the fluid storage connector; the electric connector, the fluid storage inner wall, the fluid storage connector and the universal outer wall form an oil-storage annular cavity; the fluid storage connector is provided with a plurality of fluid storage connector cable channels and a plurality of fluid storage connector hydraulic oil channels in an axial direction; the fluid storage connector hydraulic oil channels are communicated with the oil-storage annular cavity;

the hydraulic control short section comprises a hydraulic control connector, a hydraulic control inner wall and a universal outer wall, wherein the hydraulic control inner wall is coaxially sheathed in the universal outer wall; a left end of the hydraulic control inner wall is connected with a right end of the fluid storage connector; an inner surface and an outer surface of a left end of the hydraulic control connector are respectively connected with the hydraulic control inner wall and the universal outer wall; the fluid storage connector, the universal outer wall, the hydraulic control connector and the hydraulic control inner wall form a second annular cavity in which a hydraulic control system is mounted; the hydraulic control connector is provided with a plurality of first hydraulic channel hydraulic control short section segments and a plurality of second hydraulic channel hydraulic short section segments in an axial direction; the fluid storage connector hydraulic oil channels are communicated with the first hydraulic channel hydraulic control short section segments and the second hydraulic channel hydraulic control short section segments respectively;

the slide sleeve short section comprises a slide sleeve outer wall, a slide sleeve inner wall and an inner slide sleeve, wherein a left end of the slide sleeve outer wall is connected with an outer surface of a right end of the hydraulic control connector, and a right end of the slide sleeve outer wall is connected with an outer surface of a left end of the right end cover; a left end of the slide sleeve inner wall is connected with an inner surface of a right end of the hydraulic control connector, and a right end of the slide sleeve inner wall is connected with an inner surface of a left end of the right coupling connector; a right end surface of the right end cover is closely attached to a left end surface of the right coupling connector; the inner slide sleeve is slidably mounted between the slide sleeve outer wall and the slide sleeve inner wall; a plurality of slide sleeve outer wall fracturing fluid outlets is formed in a middle part of a side wall of the slide sleeve outer wall; a plurality of inner slide sleeve fracturing fluid outlets is formed in a middle part of a side wall of the inner slide sleeve; a plurality of slide sleeve inner wall fracturing fluid outlets is formed in a middle part of a side wall of the slide sleeve inner wall; during fracturing, the slide sleeve inner wall fracturing fluid outlets, the inner slide sleeve fracturing fluid outlets and the slide sleeve outer wall fracturing fluid outlets are aligned; the slide sleeve outer wall is provided with a second hydraulic channel slide sleeve outer wall section in an axial direction; the hydraulic control connector, the slide sleeve outer wall, the inner slide sleeve and the slide sleeve inner wall define a first hydraulic cavity; the first hydraulic channel hydraulic control short section segments are communicated with the first hydraulic cavity; the right end cover, the slide sleeve outer wall, the inner slide sleeve and the slide sleeve inner wall define a second hydraulic cavity; the second hydraulic channel hydraulic control short section segments are communicated with the second hydraulic cavity through the second hydraulic channel slide sleeve outer wall section.

2. The intelligent switching valve for reservoir reformation and production monitoring and control according to claim 1, wherein the slide sleeve outer wall is also provided with a slide sleeve outer wall fluid-injection opening which is communicated with the second hydraulic cavity.

3. The intelligent switching valve for reservoir reformation and production monitoring and control according to claim 1, wherein the universal outer wall is also provided with a universal outer wall fluid-injection opening which is communicated with the oil-storage annular cavity.

4. The intelligent switching valve for reservoir reformation and production monitoring and control according to claim 1, wherein the hydraulic control system comprises a first two-position three-way electromagnetic reversing valve, a second two-position three-way electromagnetic reversing valve, a direct current motor and a hydraulic pump, wherein an output end of the direct current motor is connected with an input end of a speed reducer; an output end of the speed reducer is connected with a power input end of the hydraulic pump; a fluid inlet of the hydraulic pump is connected with the oil-storage annular cavity; a fluid outlet of the hydraulic pump is connected with a first port of the first two-position three-way electromagnetic reversing valve and a first port of the second two-position three-way electromagnetic reversing valve respectively; a second port of the first two-position three-way electromagnetic reversing valve is communicated with the first hydraulic cavity; a second port of the second two-position three-way electromagnetic reversing valve is communicated with the second hydraulic cavity; a third port of the first two-position three-way electromagnetic reversing valve and a third port of the second two-position three-way electromagnetic reversing valve are communicated with the oil-storage annular cavity respectively.

5. The intelligent switching valve for reservoir reformation and production monitoring and control according to claim 4, wherein a flowmeter is also arranged at the fluid outlet of the hydraulic pump; an overflow valve is also arranged between the fluid outlet of the hydraulic pump and the third port of the first two-position three-way electromagnetic reversing valve.

6. The intelligent switching valve for reservoir reformation and production monitoring and control according to claim 1, wherein an inner surface of the slide sleeve outer wall is provided with a circumferential limiting groove in an axial direction; an outer wall of the inner slide sleeve is provided with a circumferential limiting pin in a radial direction; the circumferential limiting pin is in sliding fit with the circumferential limiting groove.

7. The intelligent switching valve for reservoir reformation and production monitoring and control according to claim 6, wherein the slide sleeve outer wall is also provided with a slide sleeve outer wall fluid-injection opening which is communicated with the second hydraulic cavity.

8. A method of operating the intelligent switching valve for reservoir reformation and production monitoring and control according to claim 1, comprising following steps:

S1, lowering multiple levels of the intelligent switching valve to an artificial well bottom along with a cementation pipe string;

S2, transmitting, by a ground control station, wireless communication signals to a shaft, wherein contents of the wireless communication signals comprise: opening a certain designated level of the intelligent switching valve, and closing the other levels of the intelligent switching valve;

S3, receiving, by each level of the intelligent switching valve under the shaft, the wireless communication signals, and opening or closing the slide sleeve inner wall fracturing fluid outlets, the inner slide sleeve fracturing fluid outlets and the slide sleeve outer wall fracturing fluid outlets successively by an electric and hydraulic control system according to instructions;

S4, transmitting, by the intelligent switching valve in the designated level under the shaft, numerical data signals of temperature and pressure measured by the temperature and pressure sensor on the designated level to the ground control station, and determining, by the ground control station, a pressure required for formation fracturing on a basis of numerical data after receiving the numerical data, so as to provide references for setting of a pressure value of a fracturing fluid during fracturing;

S5, performing a fracturing operation on a level where a fracturing fluid outlet is in an open state;

S6, repeating steps S2-S4, till the fracturing operation of an entire well section is completed;

S7, repeating steps S2-S3 to complete a calibration of productivities of all reservoirs in sequence;

S8, screening high-productivity reservoirs and transmitting, by the ground control station, the wireless communication signals to the shaft, wherein contents of the wireless communication signals comprise: opening the intelligent switching valve of all the high-productivity reservoirs and closing the intelligent switching valve of other low-productivity reservoirs to achieve oil and gas production; and S9, controlling the intelligent switching valve to finish opening, closing or throttling actions according to monitoring data from the temperature and pressure sensor and other data of oil and gas reservoirs in a production process, thereby realizing production monitoring and control.

9. The method of operating the intelligent switching valve for reservoir reformation and production monitoring and control according to claim 8, wherein the cementation pipe string comprises a surface casing, a technical casing, a production casing, a cement ring, the intelligent switching valve and a casing coupling; the intelligent switching valve is connected with the production casing via the casing coupling.

* * * * *